United States Patent [19]

Kito et al.

[11] Patent Number: 4,846,381

[45] Date of Patent: Jul. 11, 1989

[54] ICE DISPENSER

[75] Inventors: Yoshikazu Kito; Yasumitsu Tsukiyama; Susumu Tatematsu, all of Toyoake, Japan

[73] Assignee: Hoshizaki Electric Co., Ltd., Aichi, Japan

[21] Appl. No.: 127,500

[22] Filed: Dec. 1, 1987

[30] Foreign Application Priority Data

Dec. 8, 1986 [JP] Japan ..... 61-290365

[51] Int. Cl.[4] ..... B67D 5/08

[52] U.S. Cl. ..... 222/638; 222/643; 222/236; 62/233

[58] Field of Search ..... 62/233, 137, 344; 222/146.6, 236, 638, 643

[56] References Cited

U.S. PATENT DOCUMENTS

| | | | |
|---|---|---|---|
| 3,151,668 | 10/1964 | Zimmermann | 62/344 X |
| 3,651,656 | 3/1972 | Esser | 62/344 X |
| 3,858,765 | 1/1975 | Landers | 222/146.6 X |
| 3,918,266 | 11/1975 | Gindy et al. | 62/137 |
| 4,227,377 | 10/1980 | Miller | 62/233 X |
| 4,496,087 | 1/1985 | Marks | 222/638 |
| 4,676,405 | 6/1987 | Lents et al. | 222/146.6 X |
| 4,679,715 | 7/1987 | Horinga | 62/344 X |

*Primary Examiner*—William E. Tapolcai

*Attorney, Agent, or Firm*—Wenderoth, Lind & Ponack

[57] ABSTRACT

An ice dispenser comprises an ice stroage chamber within which an agitator is rotatably mounted. In response to reception of an ice dispensation signal, a motor for driving the agitator is controlled in a predetermined timing sequence independent of a period during which ice pellets are dispensed from the ice storage chamber by means of an auger and a time interval intervening between the preceeding and succeeding ice dispensing operations. To this end, a first timer for driving first the agitator and a second timer for stopping the agitator for a predetermined period are provided in association with the agitator driving motor.

11 Claims, 7 Drawing Sheets

ICE DISPENSER

BACKGROUND OF THE INVENTION

1. Field of the Invention

The present invention relates generally to an ice dispenser apparatus for discharging or dispensing an amount of ice from an ice storage chamber in response to an ice dispensation request signal and more particularly to an ice dispenser apparatus of such a novel and improved structure in which pulverization of ice pieces or pellets stored within the ice storage chamber due to agitation thereof can be suppressed to a minimum to thereby prevent occurrence of a so-called arching phenomenon in which ice pellets are rigidly connected to one another through molten ice powder resulting from the pulverized ice pellets.

2. Prior Art

Heretofore, there have been used a variety of ice dispensing machines, a typical one of which is disclosed in U.S. Pat. No. 3,651,656 and which will be described below in respect to the structure having relevance to the understanding of the present invention by referring to FIGS. 6 and 7 of the accompanying drawings in which FIG. 6 shows the known ice dispenser with portions being broken away and FIG. 7 shows an electric circuit for controlling operation of the ice dispenser.

Now referring to FIG. 6 together with FIG. 7, when an dispensing switch 110 is closed as a result of accumulation of ice pellets within an ice storage chamber 128 as produced by an ice making mechanism of the structure known per se, a relay 110 is electrically energized through a contact 112 of an ice dispensing timer 118 and an ice dispensation activating switch 114, whereby a relay contact 116 is closed. Consequently, a relay 104 is energized through a contact 102 of a time delay relay, whereupon contacts 105 and 106 are closed to positions for activating a drive motor 146 which then rotates an ice dispensing auger 140 and an agitator 160 by means of a chain 156 suspended on and around sprockets 150, 152 and 170. Thus, the ice pellets within the ice storage chamber are caused to be dispensed through a discharge port 142. The drive motor 146 is energized so long as the ice dispensing switch 110 is closed or for a period preset in the ice dispensation timer.

In the ice dispenser disclosed in the U.S. patent mentioned above, since the ice dispensing auger 140 serving for dispensation of ice and the agitator 160 for agitating the ice pellets stored within the ice storage chamber are rotated so long as the drive motor 146 is activated, some of ice pellets are likely to be pulverized into ice powder. When the pulverized ice enters gaps between the stored ice pellets and undergo melting and re-icing, there takes place an arching phenomenon in which the ice pellets are rigidly adhered to one another in an arch-like fashion. Once the arching phenomenon takes place, difficulty is encountered in discharging or dispensing satisfactorily all the ice pellets from the ice storage chamber regardless of rotation of the agitator, since those ice pellets bonded together and located outside of the region insusceptible to the action of the agitator can not be collapsed into separate ice pellets, giving rise to a problem. Besides, the arching phenomenon tends to disadvantageously increase motor torque required for rotating the agitator. Furthermore, the dispensed ice pellets tend to assume non-uniformity in respect to the size and shape, involving degradation in the quality of ice product possibly down to waste ice chips.

SUMMARY OF THE INVENTION

It is therefore a principal object of the present invention to provide an ice dispenser apparatus of such a structure in which tendency of ice pellets stored in an ice storage chamber being pulverized due to agitation thereof can be suppressed to a minimum to thereby prevent the occurrence of the arching phenomenon within the ice storage chamber.

In view of the above object, an ice dispenser according to the present invention is designed to control drive motor means for agitator means mounted rotatably within the ice storage chamber in a predetermined sequence independent of the time required for dispensing ice pellets from the ice storage chamber by an ice dispensing mechanism and a time interval between a given dispensing operation and a succeeding one. To this end, a first timer for causing the agitator means to be driven first and a second timer for stopping subsequently the agitator means for a predetermined period or interval are provided in association with the agitator driving motor means.

More specifically, in the ice dispenser apparatus according to a preferred embodiment of the present invention, the agitator driving motor means and the ice dispensing mechanism mounted rotatably within the ice storage chamber are electrically energized in response to an ice dispensation request or command signal generated by an ice dispensing lever switch which is actuated when ice pellets stored in the ice storage chamber are to be dispensed. The ice dispenser is characterized by provision of first relay means for allowing the ice dispensing mechanism to operate over a period during which the ice dispensation request signal is generated and provision of second relay and timer means which become operative to energize the agitator drive motor means over a first preceding period in response to generation of the ice dispensation request signal and deenergize the agitator drive motor means for a second succeeding period.

In the operation of the ice dispenser apparatus, the agitator means is driven to rotate for a first period of a relatively short duration (e.g. of 0.5 to 1 second), which agitator means is stopped upon lapse of the first period and subsequently remains in the rest state for a second predetermined period of a relatively long duration (e.g. of 10 to 20 seconds). By operating intermittently the agitator means in this manner, undesirable production of ice powder (i.e. pulverized ice) can be reduced very significantly as compared with the prior art ice dispenser in which the agitator is continuously driven throughout the ice dispensing operation. In other words, the period during which the agitator is driven is set to a duration short but long enough to prevent the arching phenomenon from occurrence. Accordingly, the ice pellets can be protected against the agitating action of a long duration, whereby generation of the ice powder is correspondingly decreased. In this manner, occurrence of the arching phenomenon due to pulverization of ice, if any, can be limited only to the region surrounding the outer periphery of the rotating agitator, whereby the ice pellets bonded together can be again easily collapsed under the action of the agitator. In other words, with the rotation of the agitator over only a small angular distance (of about 30° to 60° in terms of angle of rotation), the ice pellets can be maintained in the substantially loose state to be easily fed into the dispensing auger.

BRIEF DESCRIPTION OF THE DRAWINGS

In the course of the following detailed description, reference will be made to the attached drawings in which.

DESCRIPTION OF THE PREFERRED EMBODIMENTS

Figure 1:
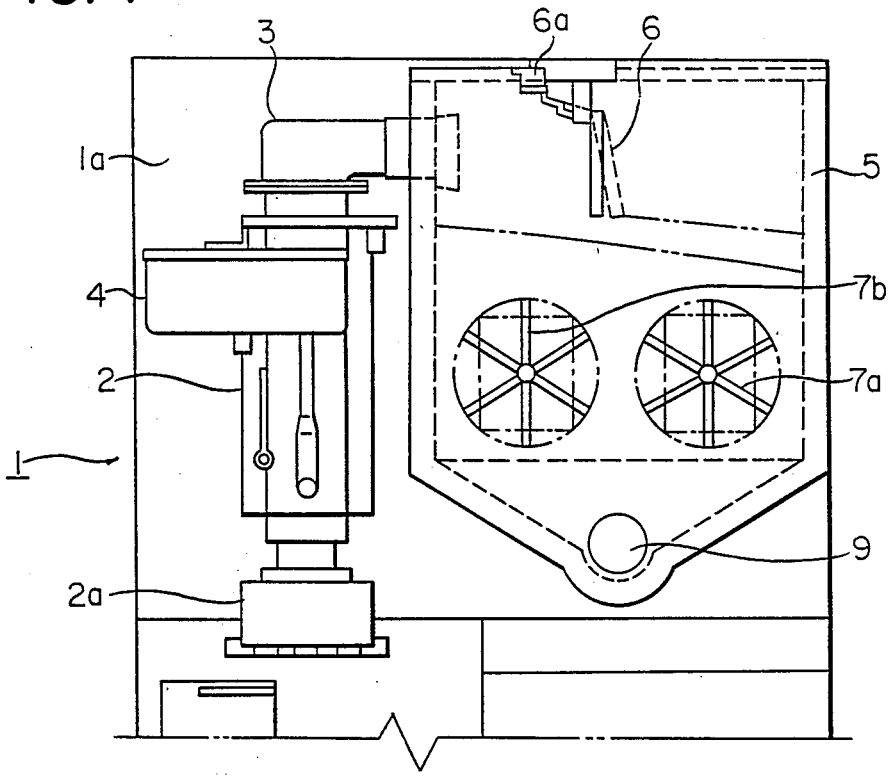
FIG. 1 shows schematically in a side view a typical ice dispenser apparatus to which the invention can be applied.
Figure 2:
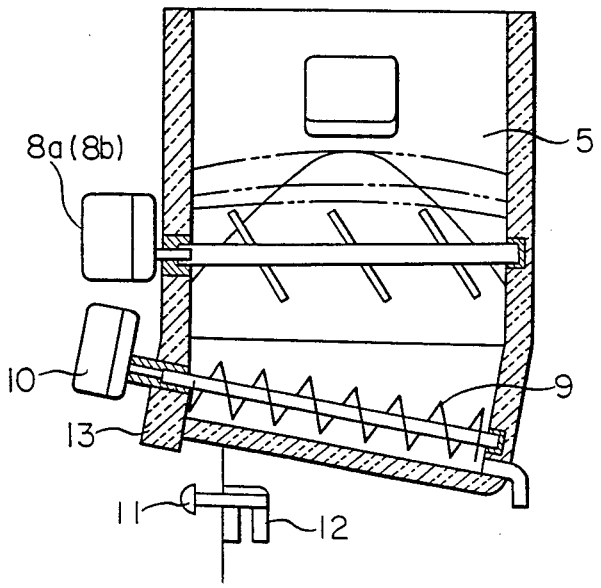
FIG. 2 is a vertical sectional view of the ice dispenser apparatus shown in FIG. 1 taken along a line passing an ice storage chamber provided in the apparatus.

Now, referring to the drawings and more particularly to FIG. 1 and 2, a reference numeral 1 denotes a cabinet or housing of an ice dispenser constructed according to the present invention which is generally of a box-like configuration and includes a machine chamber 1a formed therein. Disposed fixedly within the machine chamber 1a are an ice making mechanism 2 having a discharge port 3 and a water tank 4 containing water to be supplied to the ice making mechanism 2. An ice storage chamber or stocker 5 made of a heat insulation material is mounted adjacent to the discharge port 3 of the ice making mechanism 2. Mounted within the ice storage chamber 5 at a top portion thereof is an ice storage level sensor 6 which serves to detect the state of the ice storage chamber 5 filled with ice pellets to the full capacity thereof and produces a signal for stopping operation of the ice making mechanism 2. Parenthetically, the ice making mechanism 2 may be implemented in the form of a so-called auger type ice making machine whose structure is well known in the art and thus omitted from detailed illustration. It should however be mentioned that in the auger-type ice making machine, water fed into a cylinder from the water tank 4 is cooled by a coolant flowing through a cooling pipe wound around the outer periphery of the cylinder to be thereby frozen to form an ice layer on the inner wall of the cylinder. The ice layer is then scraped off therefrom by means of a rotatable auger member driven by an auger drive motor 2a. The flakes of ice resulting from the scraping are compressed together to be reformed to columns of ice, which are then pushed upwardly to the discharge port 3.

Disposed within the ice storage chamber 5 in a manner known heretofore are agitators 7a and 7b for agitating the ice pellets stored within the ice storage chamber, which agitators also may be of known structure such as, for example, a rotatable shaft provided with a helical blade and driven by respective agitator drive motors 8a and 8b shown in FIG. 2.

Further, an ice dispensing switch 12 is provided at a position beneath the ice storage chamber 5 for producing an ice dispensation request signal in response to actuation of an ice dispensing lever 11. More specifically, an ice dispensing auger member 9 is rotatably mounted on the bottom of the ice storage chamber 5 and adapted to perform the ice dispensing operation upon actuation of the ice dispensing lever 11, while a motor 10 for driving the ice dispensing auger in response to the signal produced by the ice dispensing switch 12 is provided externally of the ice storage chamber 5.

Figure 3:
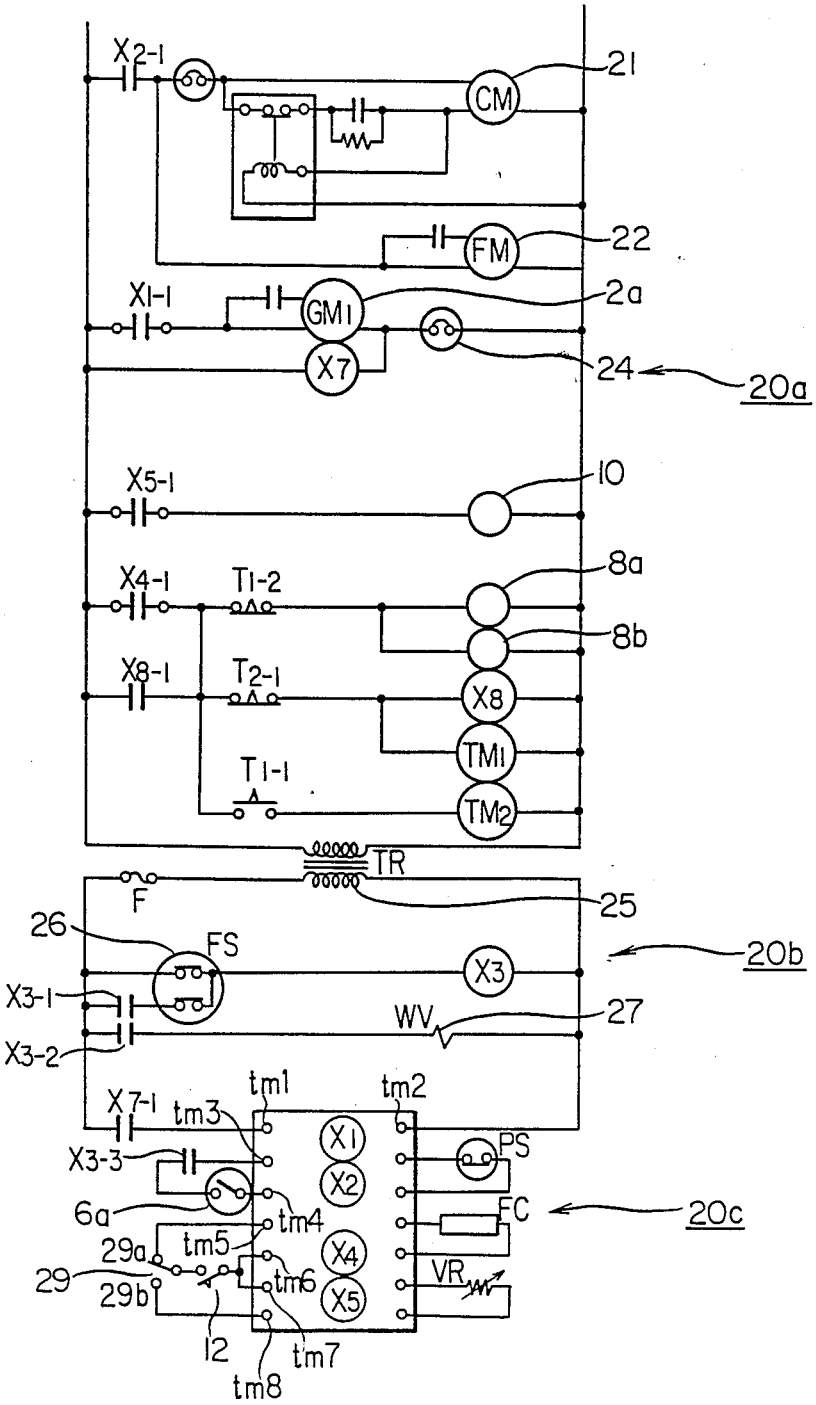
FIG. 3 is a schematic diagram of a control circuit for controlling operation of the ice dispenser apparatus shown in FIGS. 1 and 2 in accordance with an exemplary embodiment of the invention.

FIG. 3 shows in a diagram a control circuit for controlling operation of the ice dispenser according to an exemplary embodiment of the invention. The control circuit is composed of a refrigeration control circuitry 20a for controlling a refrigeration system for the ice making mechanism 2 which includes a compressor, a fan drive motor, a condenser, the auger drive motor 2a and others, a water supply control circuitry 20b including a float switch disposed within the water tank 4 and others, and a master control circuitry 20c implemented on a single chip or substrate which may be constituted by a microcomputer or the like.

The compressor 21 which is a component of the refrigeration system is connected in series to a normally open contact $X_{2-1}$ of a second relay $X_2$ described in detail hereinafter, while the fan motor 22 which also constitutes a part of the refrigeration system is connected in parallel with the compressor 21, and the auger drive motor 2a of the ice making mechanism 2 (FIG. 1) is connected in series to a normally open contact $X_{1-1}$ of a first relay $X_1$ described hereinafter and a protector 24. A seventh relay $X_7$ is connected in parallel with the serial connection of the auger drive motor 2a and the abovementioned normally open contact $X_{1-1}$. The motor 10 for driving the ice dispensing auger 9 constituting a main part of the ice dispensing mechanism is connected in series with a normally open contact $X_{5-1}$ of a fifth relay $X_5$. Further, the agitator drive motors 8a and 8b for driving the agitators 7a and 7b, respectively, are connected in parallel with each other, wherein this parallel connection is connected in series to a contact $T_{1-2}$ of a first timer $TM_1$, which in turn is connected in parallel with an eighth relay $X_8$. The parallel connection of the first timer $TM_1$ and the eighth relay $X_8$ is connected in series with a contact $T_{2-1}$ of a second timer $TM_2$, which in turn is connected in series with a contact $T_{1-1}$ of the first timer $TM_1$. All the connections mentioned above are connected to a power supply source (not shown) by way of a parallel connection of a normally open contact $X_{4-1}$ of a fourth relay $X_4$ and a contact $X_{8-1}$ of the eighth relay $X_8$.

The water suppry system control circuitry 20b and the master control circuitry 20c are connected to the low voltage side of a transformer 25 constituting a low voltage power supply source. In the water supply system control circuitry 20b, the float switch 26 for controlling the water level within the water tank 4 is connected in parallel with a normally open contact $X_{3-1}$ of a third relay $X_3$, and this parallel connection is connected in series to the third relay $X_3$. Further, a solenoid of a water supply valve 27 for supplying water to the water tank 4 is connected in series with a normally closed contact $X_{3-2}$ of the third relay $X_3$, and this serial connection is connected in series to the low voltage power supply source (i.e. the low voltage winding of the transformer 25).

The master control circuitry 20c has terminals $tm_1$ and $tm_2$ connected to the low voltage power supply source by way of a normally open contact $X_{7-1}$ of the seventh relay $X_7$, and includes first, second, fourth and fifth relays $X_1$, $X_2$, $X_4$ and $X_5$. Connected across the terminals $tm_3$ and $tm_4$ of the master control circuitry 20c is a serial connection of a normally open contact $X_{3-3}$ of the third relay $X_3$ and a switch contact 6a of the ice storage level sensor 6. Terminals $tm_5$ and $tm_8$ are connected to a change-over switch 29, while terminals $tm_6$ and $tm_7$ are connected to each other and to the ice dispensing switch 12. When the change-over switch 29 is thrown to a contact 29a for establishing a constant amount dispensing operation mode, the ice dispensing auger 9 is controlled in the mode for dispensing ice pellets in a predetermined constant amount. On the other hand, when the change-over switch 29 is thrown to a contact 29b for establishing a continuous ice dispensing mode, the ice dispensing auger 9 is controlled in the mode for dispensing ice pellets continuously.

Figure 4:
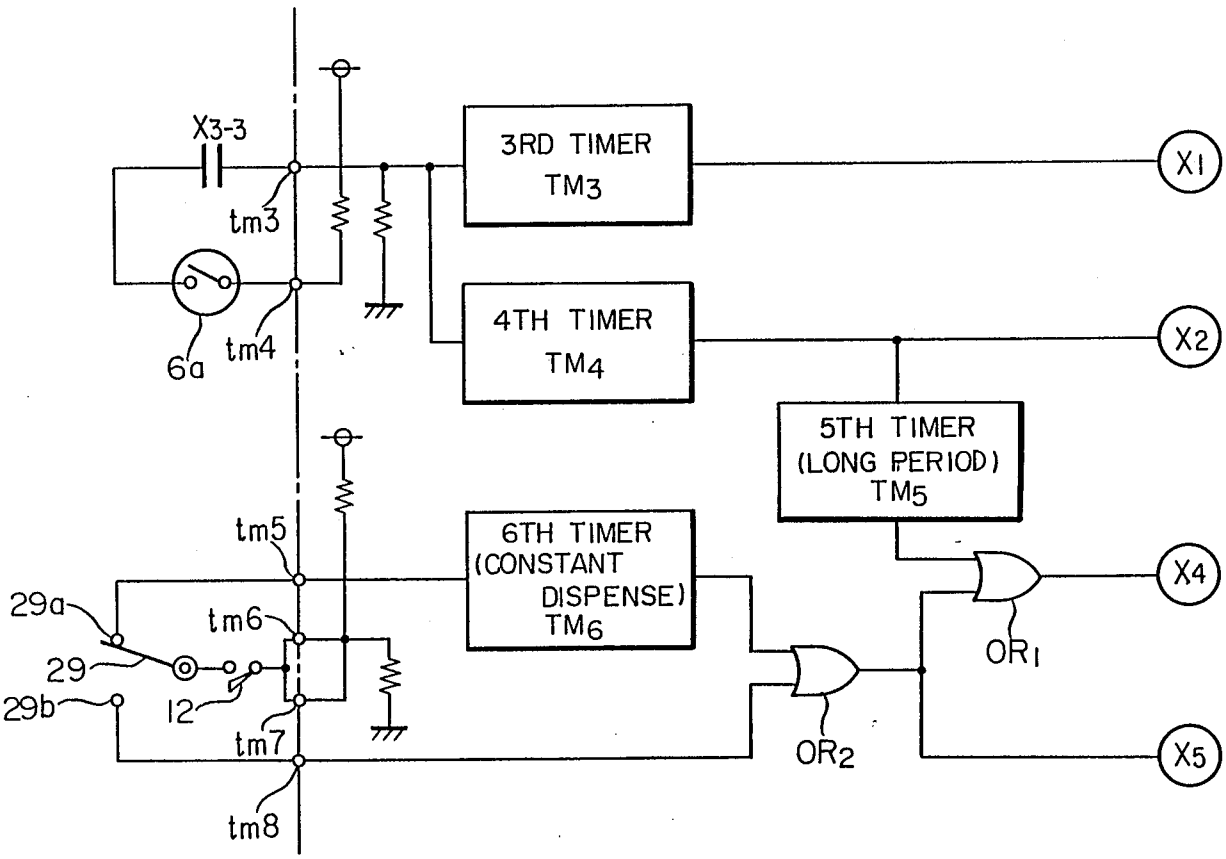
FIG. 4 is a circuit diagram showing a circuit configuration of a single-chip control circuitry incorporated in the control circuit shown in FIG. 3.

The master control circuitry 20c may be constituted by a microcomputer or realized in a conventional electric circuit composed of discrete elements. An exemplary internal circuit configuration of the master control circuitry 20c is shown in FIG. 4 in a block diagram. In this connection, it should be mentioned that the circuit arrangement shown in FIG. 4 is merely to serve for illustrating the internal function of the master control circuitry 20c and thus may be replaced by any other means so far as the equivalent function can be attained.

Figure 5A:
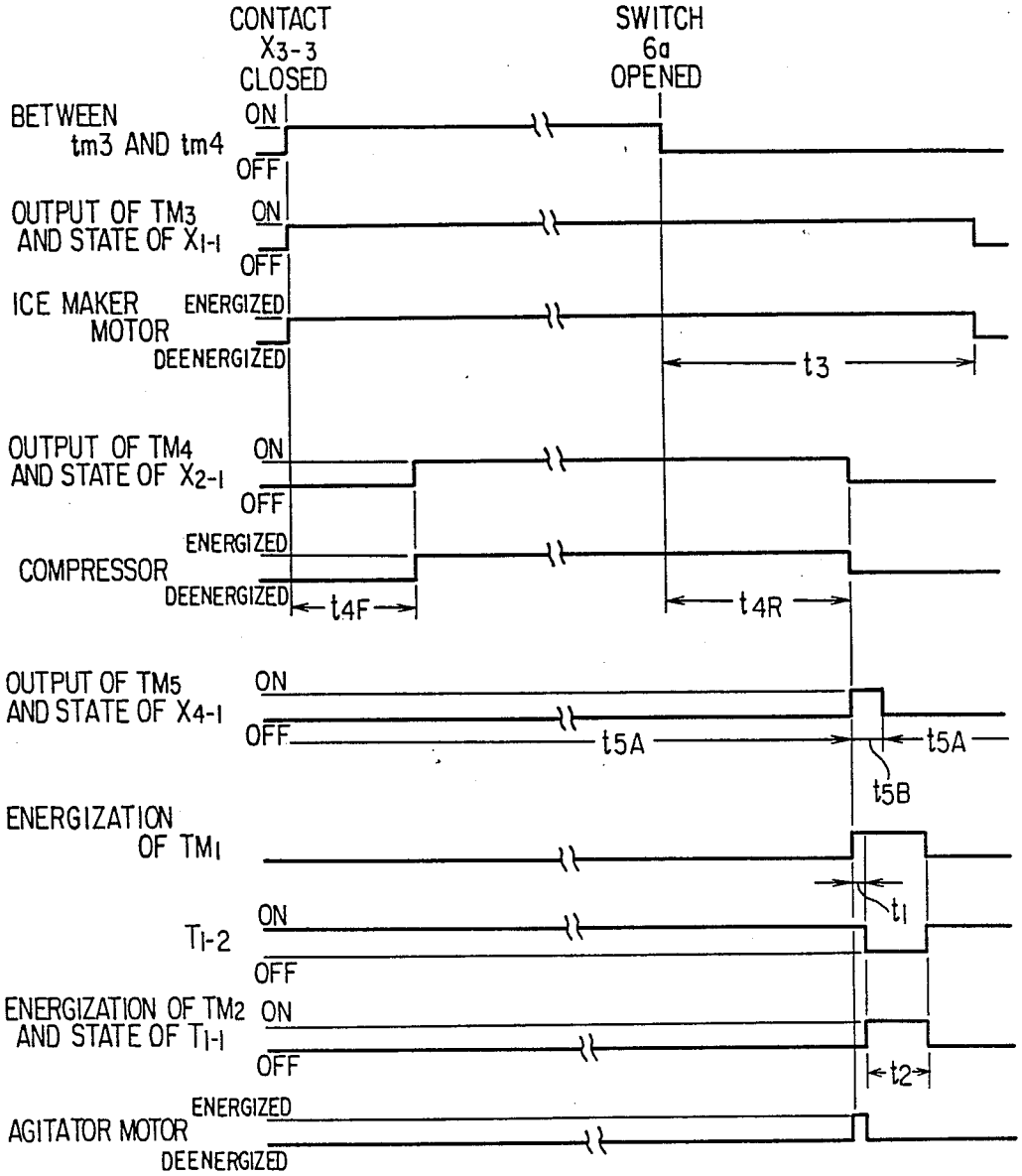
FIGS. 5A, 5B and 5C show various timing charts for illustrating operations of the circuits shown in FIGS. 3 and 4.

Referring to the block diagram shown in FIG. 4, there are included in the master control circuitry 20c a third electronic timer $TM_3$, a fourth timer $TM_4$, a fifth timer $TM_5$ which may also be referred to as a long duration timer, and a sixth timer $TM_6$ also referred to as the constant amount dispensing timer. The timing operations of these timers are illustrated in FIG. 5A. Referring to FIG. 5A in combination with FIG. 4, the third timer $TM_3$ responds to a closed circuit signal appearing at the terminal $tm_3$ to output a signal for energizing the first relay $X_1$ while it responds to disappearance of the closed circuit signal at the terminal $tm_3$ to interrupt the energization command signal to the first relay $X_1$ with a time lag $t_3$ (which may be on the order of 150 seconds). The fourth timer $TM_4$ responds to the closed circuit signal appearing at the terminal $tm_3$ to produce a signal for energizing the second relay $X_2$ with a time delay $t_{4F}$ (e.g. of 60 seconds) while interrupting the energization command signal to the second relay $X_2$ in response to disappearance of the above-mentioned closed circuit signal from the terminal $tm_3$ with a delay of time $t_{4R}$ (e.g. of 90 seconds). The long duration timer or fifth timer $TM_5$ is adapted to produce an ON signal for a predetermined short period $t_{5B}$ (e.g. of 2 seconds) after having been held in the OFF state for a predetermined long duration $t_{5A}$ (e.g. of two hours) and again assume the OFF state for the long period $t_{5A}$, which operation is automatically repeated. When the output signal of the fourth timer $TM_4$ changes from the ON state to the OFF state, i.e. when the energization command signal for the second relay $X_2$ disappears, the ON signal mentioned above is instantly produced for the predetermined short duration $t_{5B}$ (e.g. of 2 seconds), upon lapse of which the repetitive operation of the long duration timer $TM_5$ is automatically carried out. The sixth timer $TM_6$ also referred to as the constant amount dispensing timer is so designed as to produce the ON signal for a predetermined period $t_6$ from the time point when the input signal to the sixth timer $TM_6$ changes from OFF to ON state or level, as is illustrated in the timing chart shown in FIG. 5B.

Now, operations of the ice dispenser apparatus and the control circuit shown in FIGS. 1 to 4 will be explained by referring to FIGS. 5A, 5B and 5C.

When the power supply source (not shown) is turned on, the solenoid of the water supply valve 27 is electrically energized by way of the normally closed contact $X_{3-2}$ of the third relay $X_3$, as the result of which the water supply valve 27 is opened to start the water supply to the water tank 4. Upon attainment of a predetermined water level within the water tank 4 and hence within the icing cylinder of the ice making mechanism 2, the float switch 26 installed within the water tank 4 is closed, whereby the third relay $X_3$ connected in series to the float switch 26 is electrically energized to open the normally closed contact $X_{3-2}$ thereof, resulting in that the water supply valve 27 is closed. Simultaneously with the opening of the normally closed contact $X_{3-2}$, the normally open contact $X_{3-3}$ is closed, whereby a closed circuit is established between the terminals $tm_3$ and $tm_4$ of the master control circuitry 20c by way of the contact 6a of the ice storage level sensor switch 6 when it is closed at this time point. As a result, the third and fourth timers $TM_3$ and $TM_4$ of the master control circuitry 20c shown in FIG. 4 start the time count operation.

As described hereinbefore, since the third timer $TM_3$ produces the energization command signal for the first relay $X_1$ instantly upon formation of the above-mentioned closed circuit, the first relay $X_1$ is energized at first to close the normally open contact $X_{1-1}$ thereof shown in FIG. 3, whereby the auger drive motor 2a of the ice making mechanism 2 is driven. After lapse of the time $t_{4F}$, the fourth timer $TM_4$ produces the energization command signal for the second relay $X_2$, whereupon the normally open contact $X_{2-1}$ of the relay $X_2$ is closed. Consequently, the compressor 21 and the fan motor 22 are driven to start the ice making cycle.

The ice pellets produced by the ice making mechanism 2 during the ice making operation thereof are discharged through the ice discharge port 3 into the ice storage chamber 5 to be progressively accumulated therein. When the ice storage chamber 5 becomes full of the ice pellets, the storage level sensor switch 6 is actuated to open the contact 6a thereof. As a result, the closed circuit path formed between the terminals $tm_3$ and $tm_4$ of the master control circuitry 20c is opened. Upon lapse of the time $t_{4R}$ from this time point, the output signal of the fourth timer $TM_4$ is changed over from the ON state to the OFF state, whereby the energization command signal for the second relay $X_2$ is interrupted to stop the operation of the compressor 21 and the fan motor 22, while the long duration timer, i.e. the fifth timer $TM_5$ produces the ON signal for the predetermined short time $t_{5B}$ (e.g. of 2 seconds) upon detection of the ON-to-OFF changing-over of the fourth timer $TM_4$. The ON signal from the fifth timer $TM_5$ energizes the fourth relay $X_4$ through an OR circuit $OR_1$ for the predetermined short period $t_{5B}$, whereby the normally open contact $X_{4-1}$ of the fourth relay $X_4$ shown in FIG. 3 is closed.

In response to the closing of the normally open contact $X_{4-1}$ of the fourth relay $X_4$, the agitator drive motors 8a and 8b are activated. At that time, the eighth relay $X_8$ and the first timer $TM_1$ connected in parallel with the motors 8a and 8b as shown in FIG. 3 are also energized. Upon energization of the eighth relay $X_8$, the normally open contact $X_{8-1}$ thereof connected in parallel with the normally open contact $X_{4-1}$ is closed. On the other hand, upon energization of the first timer $TM_1$, the timer contact $T_{1-1}$ thereof is closed with the timer contact $T_{1-2}$ being opened after lapse of a first preset time $t_1$ (e.g. of 0.5 to 1 second), resulting in that the agitator drive motors 8a and 8b are deenergized. In this way, the agitator drive motors 8a and 8b are driven in response to the energization of the fourth relay $X_4$ only for the first period of the duration $t_1$ preset at the first timer $TM_1$. Further, the closing of the timer contact $T_{1-1}$ brings about energization of the second timer $TM_2$ whose contact $T_{2-1}$ is then opened after lapse of a second period $t_2$ (preferably longer than 10 seconds although depending on the dispensing pattern). The opening of the timer contact $T_{2-1}$ is accompanied with deenergization of the first timer $TM_1$, resulting in that the timer contact $T_{1-2}$ is again closed. However, at this time point at which the second present time $t_2$ has lapsed, the agitator drive motors 8a and 8b can be no more energized because the normally open contact $X_{4-1}$ which is closed only for the predetermined short period $t_{5B}$ (e.g. of 2 seconds) has already been opened.

As will be now be appreciated, the agitator drive motors 8a and 8b are driven only for the first preset period (e.g. of 0.5 second) after lapse of the time $t_{4R}$ from the time point at which the ice storage level sensor switch 6a was opened by detecting the state of the ice storage chamber 5 filled with the ice pellets, whereby a cone-like heap of the ice pellets as accumulated is collapsed substantially flat. Subsequently, if the ice storage level sensor switch 6a still remains in the opened stage, indicating the ice-filled state of the ice storage chamber 5, then the third timer $TM_3$ interrupts the energization command signal for the first relay $X_1$ after lapse of the third preset time $t_3$ from the opening of the ice storage level sensor switch 6a, resulting in that the normally open contact $X_{1-1}$ of that relay is opened to deenergize the auger drive motor 2a, whereupon the ice making operation cycle comes to an end.

When ice pellets are held within the storage chamber 5 without being dispensed for a long period, there is the possibility that a smooth dispensing operation might be hindered. For the purpose of avoiding such undesirable situation, the agitators are driven periodically. To this end, the long duration timer, i.e. the fifth timer $TM_5$ is so set that the ON signal is outputted upon every lapse of a predetermined long period $t_{5A}$ (e.g. of 2 hours), as is illustrated in FIG. 5A, to thereby energize the agitator drive motors for the first time period $t_1$ (e.g. of 0.5 second) for making even and mixing the heap of ice pellets.

The ice dispensing operation (i.e. operation for dispensing ice pellets from the ice storage chamber 5) can be effected either in a constant amount dispensing mode in which a predetermined constant amount of ice is dispensed at a time or alternatively in a continuous dispensing mode in which ice dispensing operation is continued so long as the ice dispensing switch lever 11 is actuated. The constant amount dispensing mode is realized by throwing the change-over switch 29 shown in FIGS. 3 and 4 to the constant amount dispensing mode contact 29a, while the continuous dispensing mode is effectuated by throwing the change-over switch 29 to the continuous dispensing mode contact 29b.

Figure 5B:
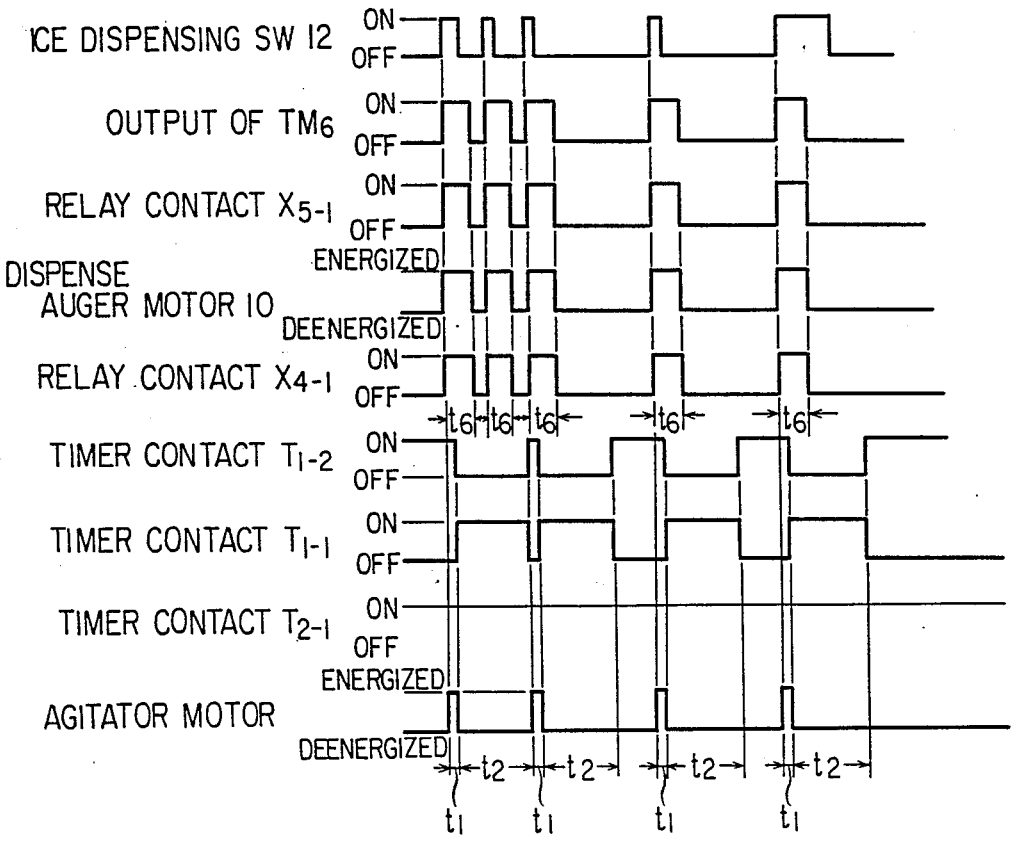

FIG. 5B illustrates timing operation in the constant amount dispensing mode. In the case of this mode, when the switch 12 is closed by pushing the ice dispensing switch lever 11, the constant amount dispensing timer or the sixth timer $TM_6$ is turned on to cause the fourth and fifth relays $X_4$ and $X_5$ to be electrically energized, whereby the respective normally open contacts $X_{4-1}$ and $X_{5-1}$ are closed for a predetermined time $t_6$ starting from the turn-on of the sixth timer $RM_6$. Consequently, the drive motors 8a and 8b for the agitators 7a and 7b, respectively, which are connected in series to the normally open contact $X_{4-1}$ are energized to mix the ice pieces evenly for facilitating the dispensing thereof, while the drive motor 10 for the ice dispensing auger 9 connected in series to the abovementioned normally open contact $X_{5-1}$ is also rotated for a predetermined time duration $t_6$, wehreby the ice pieces or pellets are dispensed through the ice dispensing port 13 outwardly from the ice storage chamber 5. In this manner, through the dispensing operation continued for the predetermined time $t_6$, a corresponding amount of ice can be dispensed from the storage chamber 5.

In this case, the period for which the ice dispensing auger drive motor 10 is energized is equal to the aforementioned predetermined time $t_6$ for which the constant amount dispensing timer $TM_6$ continues to produce the energization command signal. However, it should be noted that the time for which the agitator drive motors 8a and 8b are energized is equal to the duration $t_1$ (preferably, e.g. of 0.5 to 1 second) set by the first timer $TM_1$, as described hereinbefore in conjunction with FIG. 5A and also can be seen in FIG. 5B. When the ice dispensing switch 12 is operated in the course of lapse of the time $t_2$ (preferably longer than 10 seconds although depending on the dispensing pattern) set at the second timer $TM_2$ in succession to the lapse of the period $t_1$, the ice dispensing auger drive motor 11 is energized while the agitator drive motors 8a and 8b remain without being operated, as can be seen in FIG. 5B. In this manner, the agitators 7a and 7b are actuated only for the duration and the number of times as required for ensuring the smooth ice dispensing operation according to the invention. In case the amount of ice to be dispensed at a time in the constant amount dispensing mode is large with the time $t_6$ longer than $(t_1 + t_2)$ being set at the sixth timer $TM_6$ referred to as the constant amount dispensing timer, the agitators 7a and 7b are operated intermittently for the first time period $t_1$ upon every lapse of the time span or period $(t_1 + t_2)$. Thus, the agitators 7a and 7b are allowed to be rotated so far as the amount of ice pellets required for being fed by the ice dispensing auger 9 is available within the ice storage chamber.

Figure 5C:
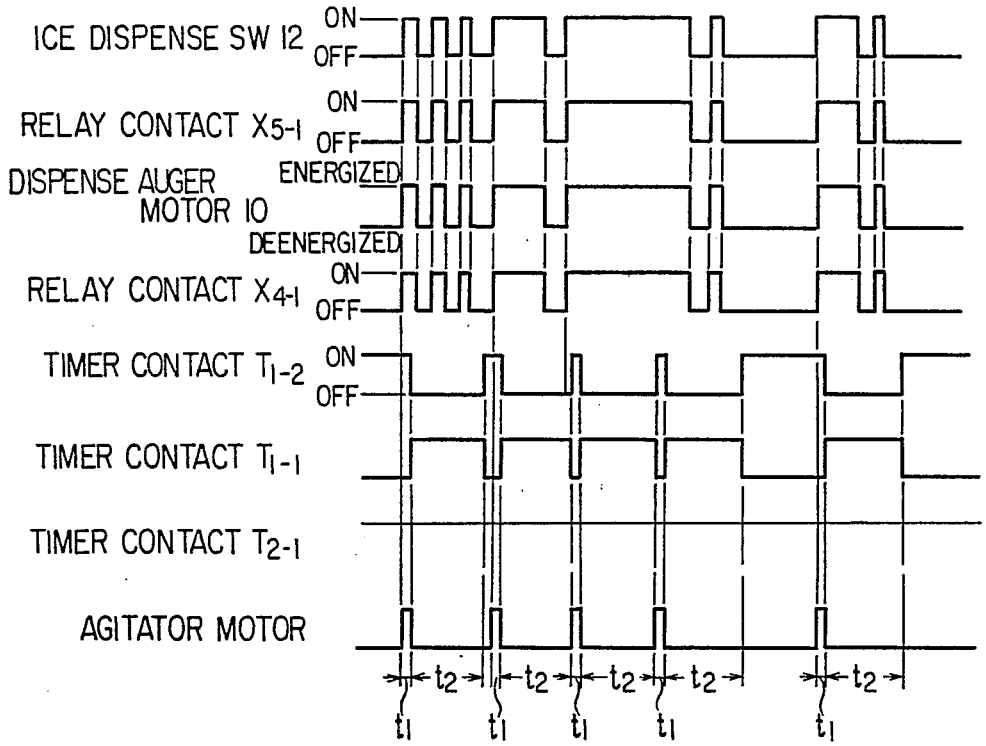
Figure 6:
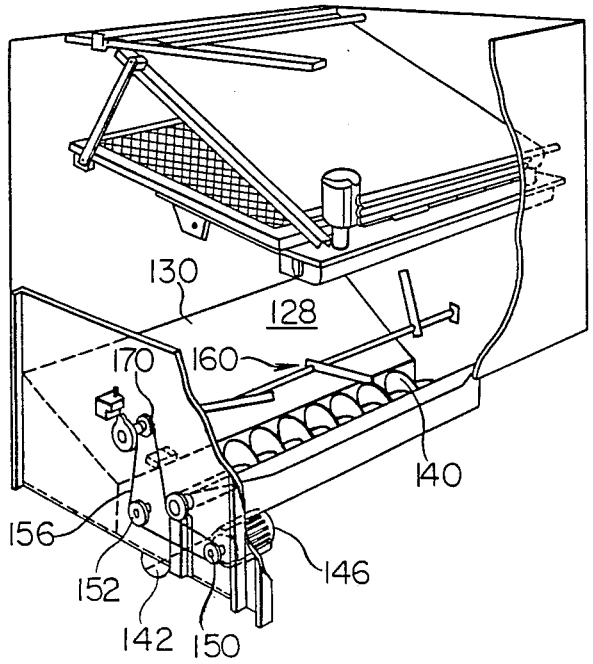
FIG. 6 PRIOR ART
FIG. 6 is a perspective view showing a main portion of a hitherto known ice dispenser apparatus with parts being broken away.
Figure 7:
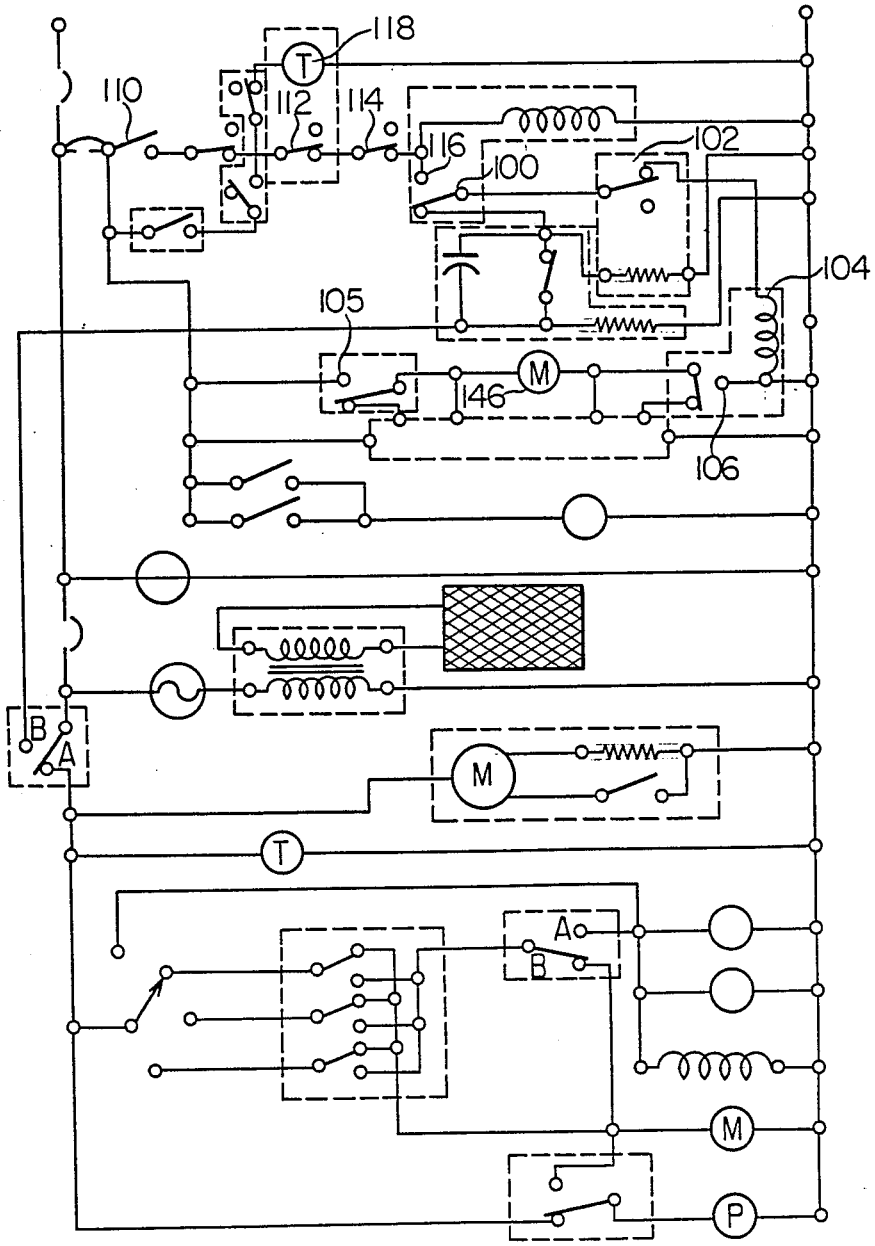
FIG. 7 PRIOR ART
FIG. 7 is a diagram showing a control circuit arrangement for the ice dispenser shown in FIG. 6.

FIG. 5C is a view for illustrating the timing operation in the continuous dispensing mode. In this mode, the ice dispensing signal, i.e. the signal for energizing the fourth relay $X_4$ and the fifth relay $X_5$ is produced continuously so long as the ice dispensing switch lever 11 is pressed, wehreby the normally open contacts $X_{4-1}$ and $X_{5-1}$ of these relays are closed to energize the ice dispesing auger drive motor 10 as well as the agitator drive motors 8a and 8b. However, the rotation of the agitator drive motors 8a and 8b is limited to the time duration or period $t_1$ from the time point when the ice dispensing lever 11 was operated, so that the agitator drive motors 8a and 8b remain in the deenergized state during the succeeding period $t_2$ regardless of the repeated actuation of the ice dispensing switch lever 11, as described hereinbefore. Further, when the ice dispensing switch lever 11 is pressed continuously for a period longer than $(t_1+t_2)$, the ice dispensing auger drive motor 10 continues to run for that period, while the agitator drive motors 8*a* and 8*b* are operated intermittently only for the first timer period $t_1$ upon every lapse of the duration $(t_1+t_2)$, as described hereinbefore.

In conjunction with the operation illustrated in FIGS. 5A, 5B and 5C, it is preferred that the first and second timers $TM_1$ and $TM_2$ be provided with time adjusting means so that the first and second timer periods $t_1$ and $t_2$ can be variably adjusted.

As will be appreciated from the foregoing description, the fifth relay $X_5$ constitutes a first means for activating the operation of the ice dispensing mechanism and more specifically the ice dispensing auger 9 over a period during which the ice dispensation request signal is issued, while the fourth relay $X_4$, the eighth relay $X_8$, the first timer $TM_1$ and the second timer $TM_2$ cooperate together to constitute second means for energizing the agitators for the first period $t_1$ and subsequently deenergizing the agitators for the second period $t_2$ in response to the ice dispensation request signal generated only once.

It should be mentioned again that in the ice dispensing modes described hereinbefore in conjunction with FIGS. 5B and 5C, the agitators 7*a* and 7*b* are not rotated continuously over the whole ice dispensing period during which the ice dispensing auger drive motor is continuously energized but is rotated only during the possible shortest period which is required for assuring the smooth and satisfactory ice dispensing operation. This is advantageous in that not only the amount of pulverized ice produced during the rotation of the agitator can be suppressed to a minimum, but also the ice powder as produced can be discharged externally of the ice storage chamber together with the ice pellets without being left within the chamber, whereby the so-called arching phenomenon can be positively prevented from occurring in the ice storage chamber. Besides, by virtue of the periodical activation of the agitator drive motors for the possible shortest period, a torque of the drive motor required for assuring the satisfactory ice dispensing operation can be reduced significantly in addition to the advantageous effect of preventing the occurrence of the arching phenomenon.

Although the invention has been described as applied to the ice dispenser in which a pair of agitators are employed, it should be appreciated that application of the invention is never restricted to the number of the agitators. The invention can be applied to the ice dispenser equipped with one or three or more agitators for assuring the improved ice dispensing operation while suppressing the occurrence of the arching phenomenon.

Further, although description has been made in conjunction with the illustrated embodiment to the effect that the second means constituted by the first timer $TM_1$, the second timer $TM_2$, the eighth relay $X_8$, etc. for controlling the rotation of the agitator drive motors 8*a* and 8*b* are incorporated in the refrigeration system control circuitry 20*a*, it will be readily understood by those skilled in the art that the second means may be implemented in the master control circuitry 20*c* in the form of electronic timers and relays, wherein the agitator drive motor is directly energized by the normally open contact $X_{4-1}$ of the fourth relay $X_4$. With this arrangement, the number of wiring steps can be reduced, whereby the invention can be carried out economically.

As will be seen, the ice dispenser according to the present invention which is so arranged as to inhibit the rotation of the agitator(s) for a predetermined period independent of the ice dispensing period in the ice dispensing modes and in which the agitators are rotated only for the shortest time required to assure the satisfactory ice dispensing operation upon every lapse of the predetermined period can suppress the amount of pulverized ice as produced to a minimum to thereby prevent the arching phenomenon which otherwise would hinder the ice pellet dispensing operation.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and all equivalents thereof.

What we claim is:

1. In an ice dispenser apparatus including an ice storage chamber, an ice dispensing mechanism mounted rotatably within said ice storage chamber for dispensing outwardly ice pellets stored within said ice storage chamber, an ice dispensation signal generating means operatively connected to said ice dispensing mechanism for generating an ice dispensing signal to trigger operation of said ice dispensing mechanism, an agitator means mounted rotatably within said ice storage chamber for agitating the ice pellets within said ice storage chamber, and a drive means coupled to said agitator means for driving said agitator means, said driving means being operatively coupled to said ice dispensation signal generating means and adapted to be energized in response to said ice dispensing signal, the improvement comprising:

a first means operatively coupled to said ice dispensation signal generating means and said ice dispensing mechanism for causing said ice dispensing mechanism to be operated over a period during which said ice dispensing signal is issued; and a second means operatively coupled to said ice dispensation signal generating means and said driving means for energizing said driving means for a first period in response to generation of said ice dispensing signal and deenergizing said driving means for a second period which occurs subsequent to said first period; wherein said first period is substantially shorter than said period during which the ice dispensing signal is issued; and wherein said first and second periods are unrelated to both the length of time during which said ice dispensing mechanism discharges the ice pellets in the ice storage chamber and the time interval between ice pellet discharges.

2. An ice dispenser apparatus as set forth in claim 1, wherein when said period during which said ice dispensing signal is produced exceeds a sum of said first and second periods, said second means operates to execute repeatedly a cycle including the energization of said driving means over said first period and deenergization of said driving means over said second period.

3. An ice dispenser apparatus as set forth in claim 1, wherein said second means includes a time adjusting means capable of adjusting the durations of said first period and said second period, respectively.

4. An ice dispenser apparatus as set forth in claim 1, wherein said ice dispensation signal generating means includes an ice dispensing member manipulatable externally of said apparatus and an ice dispensing switch closed through manipulation of said ice dispensing member, and further including a mode change-over switch connected in series with said ice dispensing switch and capable of changing over ice dispensing operation between a continuous dispensing mode and a constant amount dispensing mode, said change-over switch having a continuous dispensing mode contact for outputting a contact signal of said ice dispensing switch intact as said ice dispensing signal and a constant amount dispensing mode contact connected in series to a constant amount dispensing timer for outputting as said ice dispensing signal a turn-on signal for a predetermined period from the time point at which said ice dispensing switch is closed.

5. An ice dispenser apparatus as set forth in claim 4, further including an ice storage level sensor mounted within said ice storage chamber, and a long duration timer ($TM_5$) operatively connected to said ice storage level sensor and said second means for counting a predetermined period of long duration when said ice storage sensor signal indicates the state full of ice over a time span exceeding said predetermined period of long duration, wherein said long duration timer outputs said ice dispensation signal to said second means for a predetermined period of short duration ($t_{5B}$) upon completion of counting of said predetermined period of long duration.

6. An ice dispenser apparatus as set forth in claim 5, wherein said ice dispensing signal is outputted to said second means for said period of short duration before ice making operation is stopped in succession to the indication of the state full of ice issued by said ice storage level sensor.

7. In an ice dispenser apparatus including an ice storage chamber, an ice dispensing mechanism mounted rotatably within said ice storage chamber for dispensing outwardly ice pellets stored within said ice storage chamber, an ice dispensation signal generating means operatively connected to said ice dispensing mechanism for generating an ice dispensing signal to trigger operation of said ice dispensing mechanism, an agitator means mounted rotatably within said ice storage chamber for agitating the ice pellets within said ice storage chamber, and a drive means coupled to said agitator means for driving said agitator means, said driving means being operatively coupled to said ice dispensation signal generating means and adapted to be energized in response to said ice dispensing signal, the improvement comprising:

a first means operatively coupled to said ice dispensation signal generating means and said ice dispensing mechanism for causing said ice dispensing mechanism to be operated over a period during which said ice dispensing signal is issued; and a second means operatively coupled to said ice dispensation signal generating means and said driving means for energizing said driving means for a first period in response to generation of said ice dispensing signal and deenergizing said driving means for a second period which occurs subsequent to said first period;

wherein when said period during which said ice dispensing signal is produced exceeds a sum of said first and second periods, said second means operates to execute repeatedly a cycle including the energization of said driving means over said first period and deenergization of said driving means over said second period.

8. In an ice dispenser apparatus including an ice storage chamber, an ice dispensing mechanism mounted rotatably within said ice storage chamber for dispensing outwardly ice pellets stored within said ice storage chamber, an ice dispensation signal generating means operatively connected to said ice dispensing mechanism for generating an ice dispensing signal to trigger operation of said ice dispensing mechanism, an agitator means mounted rotatably within said ice stroage chamber for agitating the ice pellets within said ice storage chamber, and a drive means coupled to said agitator means for driving said agitator means, said driving means being operatively coupled to said ice dispensation signal generating means and adapted to be energized in response to said ice dispensing signal, the improvement comprising:

a first means operatively coupled to said ice dispensation signal generating means and said ice dispensing mechanism for causing said ice dispensing mechanism to be operated over a period during which said ice dispensing signal is issued; and a second means operatively coupled to said ice dispensation signal generating means and said driving means for energizing said driving means for a first period in response to generation of said ice dispensing signal and deenergizing said driving means for a second period which occurs subsequent to said first period;

wherein said second means includes a time adjusting means capable of adjusting the durations of said first period and said second period, respectively.

9. In an ice dispenser apparatus including an ice storage chamber, an ice dispensing mechanism mounted rotatably within said ice storage chamber for dispensing outwardly ice pellets stored within said ice storage chamber, an ice dispensation signal generating means operatively connected to said ice dispensing mechanism for generating an ice dispensing signal to trigger operation of said ice dispensing mechanism, an agitator means mounted rotatably within said ice storage chamber for agitating the ice pellets within said ice storage chamber, and a drive means coupled to said agitator means for driving said agitator means, said driving means being operatively coupled to said ice dispensation signal generating means and adapted to be energized in response to said ice dispensing signal, the improvement comprising:

a first means operatively coupled to said ice dispensation signal generating means and said ice dispensing mechanism for causing said ice dispensing mechanism to be operated over a period during which said ice dispensing signal is issued; and a second means operatively coupled to said ice dispensation signal generating means and said driving means for energizing said driving means for a first period in response to generation of said ice dispensing signal and deenergizing said driving means for a second period which occurs subsequent to said first period;

wherein said ice dispensation signal generating means includes an ice dispensing member manipulatable externally of said apparatus and an ice dispensing switch closed through manipulation of said ice dispensing member, and further including a mode change-over switch connected in series with said ice dispensing switch and capable of changing over ice dispensing operation between a continuous dispensing mode and a constant amount dispensing mode, said change-over switch having a continuous dispensing mode contact for outputting a contact signal of said ice dispensing switch intact as said ice dispensing signal and a constant amount dispensing mode contact connected in series to a constant amount dispensing timer for outputting as said ice dispensing signal a turn-on signal for a predetermined period from the time point at which said ice dispensing switch is closed.

10. An ice dispenser apparatus as set forth in claim 9, further including an ice storage level sensor mounted within said ice storage chamber, and a long duration timer (TMs) operatively connected to said ice storage level sensor and said second means for counting a predetermined period of long duration when said ice storage sensor signal indicates the state full of ice over a time span exceeding said predetermined period of long duration, wherein said long duration timer outputs said ice dispensation signal to said second means for a predetermined period of short duration ($t_{5B}$) upon completion of counting of said predetermined period of long duration.

11. An ice dispenser apparatus as set forth in claim 10, wherein said ice dispensing signal is outputted to said second means for said period of short duration before ice making operation is stopped in succession to the indication of the state full of ice issued by said ice storage level sensor.

* * * * *